US005133917A

United States Patent [19]

Jezic et al.

[11] Patent Number: 5,133,917

[45] Date of Patent: Jul. 28, 1992

[54] BICONSTITUENT POLYPROPYLENE/POLYETHYLENE FIBERS

[75] Inventors: Zdravko Jezic; Gene P. Young, both of Lake Jackson, Tex.

[73] Assignee: The Dow Chemical Company, Midland, Mich.

[21] Appl. No.: 302,166

[22] Filed: Jan. 25, 1989

Related U.S. Application Data

[63] Continuation of Ser. No. 13,853, Feb. 12, 1987, Pat. No. 4,839,228, which is a continuation-in-part of Ser. No. 909,345, Sep. 19, 1986, abandoned, which is a continuation-in-part of Ser. No. 946,562, Dec. 24, 1986, abandoned.

[51] Int. Cl.[5] ..... D01F 6/04; D01F 6/06; D01F 6/30; C08L 23/12

[52] U.S. Cl. ..... 264/210.8; 264/171; 264/331.17; 264/26; 525/240; 428/401; 428/373

[58] Field of Search ..... 264/210.8; 525/240

[56] References Cited

U.S. PATENT DOCUMENTS

| | | | |
|---|---|---|---|
| 4,076,698 | 2/1978 | Anderson et al. | 526/348.6 |
| 4,296,022 | 10/1981 | Hudson | 525/240 |
| 4,563,504 | 1/1986 | Hert et al. | 525/240 |
| 4,584,347 | 4/1986 | Harpell et al. | 525/240 |
| 4,632,861 | 12/1986 | Vassilatos | 525/240 |

FOREIGN PATENT DOCUMENTS

| | | |
|---|---|---|
| 1199746 | 1/1986 | Canada . |
| 0154197 | 9/1985 | European Pat. Off. . |
| 3544523 | 6/1986 | Fed. Rep. of Germany . |
| 52-072744 | 6/1977 | Japan . |
| 58-011536 | 1/1983 | Japan . |
| 58-206647 | 12/1983 | Japan . |
| 59-041342 | 3/1984 | Japan . |

OTHER PUBLICATIONS

Skoroszewaki-"Parameters affecting processing of polymers and polymer blends"-Plastics & Polymers vol. 40 No. 147 pp. 142-152-Jul. 1972.

*Primary Examiner*—Carman J. Seccuro

[57] ABSTRACT

Extrudable blends of polypropylene and polyethylene, especially LLDPE, are prepared in a dynamic mixer and extruded as novel biconstituent fibers comprising polypropylene as one phase and polyethylene as another phase. Improved tenacity and hand are obtained, as compared to polypropylene alone.

7 Claims, 2 Drawing Sheets

BICONSTITUENT POLYPROPYLENE/POLYETHYLENE FIBERS

CROSS-REFERENCE TO RELATED APPLICATIONS

This is a continuation of Ser. No. 013,853, now U.S. Pat No. 4,839,228, filed Feb. 12, 1987, which is a continuation-in-part of Ser. No. 909,345 filed Sep. 19, 1986 now abandoned and of Ser. No. 946,562 filed Dec. 24, 1986 now abandoned.

FIELD OF THE INVENTION

Blends consisting of polypropylene and polyethylene are spun into fibers having improved properties.

BACKGROUND OF THE INVENTION

Polypropylene (PP) fibers and filaments are items of commerce and have been used in making products such as ropes, non-woven fabrics, and woven fabrics.

U.S. Pat. No. 4,578,414 discloses additives for making olefin polymer fibers water-wettable, including blends of polyethylene (PE) and polypropylene (PP).

U.S. Pat. No. 4,518,744 discloses melt-spinning of certain polymers and blends of polymers, including polypropylene (PP). Japanese Kokai 56-159339 and 56-59340 disclose fibers of mixtures of polyester with minor amounts of polypropylene.

Convenient references relating to fibers and filaments, including those of man-made thermoplastics, and incorporated herein by reference, are, for example:

(a) Encyclopedia of Polymer Science and Technology, Interscience, New York, Vol. 6 (1967), pp. 505–555 and Vol. 9 (1968), pp. 403–440;

(b) Man-Made Fiber and Textile Dictionary, published by Celanese Corporation;

(c) Fundamentals of Fibre Formation—The Science of Fibre Spinning and Drawing, by Andrzij Ziabicki published by John Wiley & Sons, London/-New York, 1976;

(d) Man-Made Fibres, by R. W. Moncrieff, published by John Wiley & Sons, London/New York, 1975;

(e) Kirk-Othmer Encyclopedia of Chemical Technology, Vol. 16 for "Olefin Fibers", published by John Wiley & Sons, New York, 1981, 3rd Edition.

In conformity with commonly accepted vernacular or jargon of the fiber and filament industry, the following definitions apply to the terms used in this disclosure:

A "monofilament" (a.k.a. monofil) refers to an individual strand of denier greater than 15, usually greater than 30;

A "fine denier fiber or filament" refers to a strand of denier less than about 15;

A "multi-filament" (a.k.a. multifil) refers to simultaneously formed fine denier filaments spun as a bundle of fibers, generally containing at least 3, preferably at least about 15–100 fibers and can be several hundred or several thousand;

"Staple fibers" refer to fine denier strands which have been formed at, or cut to, staple lengths of generally about 1 to about 8 inches;

An "extruded strand" refers to an extrudate formed by passing polymer through a forming-orifice, such as a die.

A "fibril" refers to a superfine discrete filament embedded in a more or less continuous matrix.

Whereas it is known that virtually any thermoplastic polymer can be extruded as a coarse strand or monofilament, many of these, such as polyethylene and some ethylene copolymers, have not generally been found to be suitable for the making of fine denier fibers or multi-filaments. Practitioners are aware that it is easier to make a coarse monofilament yarn of 15 denier than to make a multi-filament yarn of 15 denier. It is also recognized that the mechanical and thermal conditions experienced by a bundle of filaments, whether in spinning staple fibers or in multi-filaments yarns, are very different to those in spinning monofilaments. The fact that a given man-made polymer can be extruded as a monofilament, does not necessarily herald its use in fine denier or multi-filament spinning. Whereas an extruded monofilament which has been cooled can usually be cold-drawn (stretched) to a finer denier size, even if it does not have sufficient melt-strength to be melt-drawn without breaking, it is apparent that a polymer needs to have an appreciable melt-strength to be hot-drawn to fine denier sizes.

Low density polyethylene (LDPE) is prepared by polymerizing ethylene using a free-radical initiator, e.g. peroxide, at elevated pressures and temperatures, having densities in the range, generally, of about 0.910–0.935 gms/cc. The LDPE, sometimes called "I.C.I.-type" polyethylene is a branched (i.e. non-linear) polymer, due to the presence of short-chains of polymerized ethylene units pendent from the main polymer backbone. Some of the older art refers to these as high pressure polyethylene (HPPE).

High density polyethylene (HDPE) is prepared using a coordination catalyst, such as a "Ziegler-type" or "Natta-type" or a "Phillips-type" chromium oxide compound. These have densities generally in the range of about 0.94 to about 0.98 gms/cc and are called "linear" polymers due to the substantial absence of short polymer chains pendent from the main polymer backbone.

Linear low density polyethylene (LLDPE) is prepared by copolymerizing ethylene with at least one alpha-olefin alkylene of $C_3$–$C_{12}$, especially at least one of $C_4$–$C_8$, using a coordination catalyst such as is used in making HDPE. These LLDPE are "linear", but with alkyl groups of the alpha-olefin pendent from the polymer chain. These pendent alkyl groups cause the density to be in about the same density range (0.88–0.94 gms/cc) as the LDPE; thus the name "linear low density polyethylene" or LLDPE is used in the industry in referring to these linear low density copolymers of ethylene.

Polypropylene (PP) is known to exist as atactic (largely amorphous), syndiotactic (largely crystalline), and isotactic (also largely crystalline), some of which can be processed into fine denier fibers. It is preferable, in the present invention, to use the largely crystalline types of PP suitable for spinning fine denier fibers, sometimes referred to as "CR", or constant rheology, grades.

U.S. Pat. Nos. 4,181,762, 4,258,097, and 4,356,220 contain information about olefin polymer fibers, some of which are monofilaments.

U.S. Pat. No. 4,076,698 discloses methods of producing LLDPE and discloses extrusion of a monofilament.

It has now been found, unexpectedly, that improvements are made in polypropylene fibers if the polypropylene is first blended with about 20% to about 45% by wt. of a polyethylene, especially a linear low density ethylene copolymer (LLDPE) containing, generally, about 3% to about 20% of at least one alpha-olefin alkylene of 3–12 carbon atoms. It was also found that certain polyethylenes (more specifically LLDPE's) can be blended in a molten state with polypropylene in all proportions and then melt spun into fine denier fibers, some of which offer improved properties over polyethylene and polypropylene alone.

SUMMARY OF THE INVENTION

Useful products, such as novel fibers, especially fine denier fibers, are prepared from blends of polypropylene (PP) and polyethylene (PE), especially linear low density ethylene copolymer (LLDPE). The tenacity and softness of the fibers is improved over that of the polypropylene or the polyethylene alone.

BRIEF DESCRIPTIONS OF THE DRAWINGS

FIGS. 1–4 are provided herewith as visual aids for relating certain properties of blends described in this disclosure.

DETAILED DESCRIPTION, INCLUDING BEST EMBODIMENTS

The polyethylene for use in this invention may be LDPE or HDPE, but is preferably LLDPE. The molecular weight of the polyethylene should be in the moderately high range, as indicated by a melt index, M.I., (a.k.a. melt flow rate, M.F.R.) value in the range of about 12 to about 120, preferably about 20 to about 50 gms/10 min. as measured by ASTM D-1238(E) (190° C./2.16 Kg).

Regarding the use of preferred LLDPE, it is preferred that the comonomer alpha-olefin alkylenes in the upper end of the $C_3$–$C_{12}$ range be used, especially 1-octene. Butene ($C_4$) is preferred over propylene ($C_3$) but is not as preferred as 1-octene. Mixtures of the alkylene comonomers may be used, such as butene/octene or hexene/octene in preparing the ethylene/alkylene copolymers. The density of the LLDPE is dependent on the amount of, and the molecular size (i.e. the number of carbons in the alkylene molecule) of, the alkylene incorporated into the copolymer. The more alkylene comonomer used, the lower the density; also, the larger the alkylene comonomer, the lower the density. Preferably an amount of alkylene comonomer is used which results in a density in the range of about 0.88 to about 0.94, most preferably about 0.92 to about 0.93 gms/cc. An ethylene/octene copolymer having a density of around 0.925 gms/cc, an octene content in the range of about 10–15% and a M.F.R. at or near 50 gms/10 min. is very effective for the purposes of this invention.

In the blend, the weight ratio of PP/PE can range from about 80/20 to about 10/90, but is preferably in the range of about 78/22 to about 60/40, most preferably in the range of about 75/25 to about 65/35. An especially preferred range is about 72/28 to 68/32.

The method of melt-mixing is important due to generally acknowledged immiscibility of the PP and PE. An intensive mixer-extruder is required which causes, in the blender, on the one hand, molten PE to be dispersed in the molten PP and the dispersion maintained until the mixture, as an extrudate, is expelled from the extruder. On the other hand, molten PP is dispersed in molten PE when the amount of PE exceeds the amount of PP.

The following chart is provided as a means for describing the results believed to be obtained for the various ratio ranges of PP/PE, when using PE having an M.F.R. in the range of about 12 to about 120 gms./10 min., and a crystalline PP, where the melt viscosity and melt strength are such that reasonably good melt-compatibility and miscibility are achieved by use of the high-intensity mixer-extruder:

| Approx. Range of Ratio of PE/PP | General results one may obtain* |
|---|---|
| 20/80–45/55 | PE fibrils dispersed in PP continuous matrix |
| 45/55–55/45 | co-continuous zones; lamellar structure |
| 55/45–90/10 | PP fibrils dispersed in PE continuous matrix |

*Obviously the results in or around the ratios which are overlapping at the ends of the middle range are ambigous in that some of are results obtained from both sides of the overlap.

Polymer blends of PP and PE prepared in such a mixer are found to be useful, strong, and can be extruded into products where the immiscibility is not a problem. As the so-formed extrudate of a mixture which contains more PP than PE is spun and drawn into fibers, the molten PE globules become extended into fibrils within the polypropylene matrix. An important, novel feature of the fibers is that the fibrils of PE are diverse in their orientation in the PP fiber. A larger fraction of PE particles is found close to the periphery of the cross-section of the PP fibers, and the remaining PE particles are spread in the inner portions of the PP fiber. The size of the PE particles is smallest at the periphery of the fiber's cross-section and a gradual increase in size is evidenced toward the center of the fiber. The frequency of small particles at the periphery is highest, and it decreases toward the center where the PE particles are largest, but spread apart more. The PE fibrils near the periphery of the PP fiber's cross-section are diverse in the direction in which they are oriented or splayed, whereas close to the center of the PP fiber the orientation is mostly coaxial with the fiber. For the purpose of being concise, these fibers will be referred to herein as blends consisting of PP as a continuous phase, and containing omni-directionally splayed PE fibrils as a dispersed phase.

Microscopic examination reveals that the PE fibrils, when viewed in a cross-section of the biconstituent PP fiber, are more heavily populated near the outer surface than in the middle. The shape of each PE fibril in the cross-section is dependent on whether one is viewing a PE fibril sliced at right angles to the axis of the PE fibril at that point or at a slant to the axis of the PE fibril at that point. An oval or elongate shaped section indicates a PE fibril cut at an angle. An elongate shaped section indicates a PE fibril which has skewed from axial alignment to a transverse position.

The mixer for preparing the molten blend of PP/PE is a dynamic high shear mixer, especially one which provides 3-dimensional mixing. Insufficient mixing will cause non-homogeneous dispersion of PE in PP resulting in fibers of inconsistent properties, and tenacities lower than that of the corresponding PP fibers alone A 3-dimensional mixer suitable for use in the present invention is disclosed in a publication titled "Polypropylene—Fibers and Filament Yarn With Higher Tenacity", presented at International Man-Made Fibres Congress, Sep. 25–27, 1985, Dornbirn/Austria, by Dr. Ing. Klaus Schafer of Barmag, Barmer Maschinen-Fabrik, West Germany.

The distribution of PE fibrils in a PP matrix are studied by using the following method: The fibers are prepared for transverse sectioning by being attached to strips of adhesive tape and embedded in epoxy resin. The epoxy blocks are trimmed and faced with a glass knife on a Sorvall MT-6000 microtome. The blocks are soaked in a mixture of 0.2 gm ruthenium chloride dissolved in 10 ml of 5.25% by weight aqueous sodium hypochlorite for 3 hours. This stains the ends of the fibers with ruthenium to a depth of about 30 microns. The blocks are rinsed well and remounted on the microtome. Transverse sections of fibers in epoxy are microtomed using a diamond knife, floated onto a water trough, and collected onto copper TEM grids. The grids are examined at 100 KV accelerating voltage on a JEOL 100C transmission electron microscope (TEM). Sections taken from the first few microns, as well as approximately 20 microns from the end are examined in the TEM at magnifications of 250X to 66,000X. The polyethylene component in the samples are preferentially stained by the ruthenium. Fiber sections microtomed near the end of the epoxy block may be overstained, whereas sections taken about 20 microns away from the end of the fibers are more likely to be properly stained. Scratches made by the microtome knife across the face of the section may also contain artifacts of the stain, but a skilled operator can distinguish the artifacts from the stained PE. The diameter of PE fibrils near the center of the PP fiber have been found to be, typically, on the order of about 350–500 angstrom, whereas the diameter of the more populace fibrils near the periphery edge of the PP fiber have been found to be, typically, on the order of about 100–200 angstrom. This is in reference to those which appear under high magnification to be of circular cross-section rather than oval or elongate At less than 20% polyethylene in the polypropylene one obtains better "hand" than with polypropylene alone, but without obtaining a significant increase in tenacity and without obtaining a dimensionally stable fiber. By the term "dimensionally stable" it is meant that upon storing a measured fiber for several months and then remeasuring the tenacity, one does not encounter a significant change in the tenacity. A change in tenacity indicates that stress relaxation has occurred and that fiber shrinkage has taken place. In many applications, such as in non-woven fabrics, such shrinkage is considered undesirable.

By using about 20% to about 45% polyethylene in the polypropylene one obtains increased tenacity as well as obtaining better "hand" than with polypropylene alone. By using between about 25% to about 35%, especially about 28% to about 32%, of polyethylene in the polypropylene one also obtains a substantially dimensionally stable fiber. A substantially dimensionally stable fiber is one which undergoes very little, if any, change in tenacity during storage. A ratio of polypropylene/polyethylene of about 70/30 is especially beneficial in obtaining a dimensionally stable fiber. By using about 50% to about 90% polyethylene in the blend, a reduction in tenacity may be observed, but the "hand" is noticeably softer than polypropylene alone.

A greater draw ratio gives a higher tenacity than a lower draw ratio. Thus, for a given PP/PE ratio, a draw ratio of, say 3.0 may yield a tenacity greater than PP alone, but a draw ratio of, say 2.0 may not give a greater tenacity than PP alone.

In order to establish a nominal base point for making comparisons, several commercially available PP's are spun into fine denier fibers and the results are averaged. The average denier size is found to be 2.1, the average elongation is found to be 208% and the average tenacity at the break point is 2.26 gm/denier.

Similarly, to establish a nominal base point, several LLDPE samples are spun into fine denier fibers and the results are averaged. The average denier size is found to be 2.84, the average elongation is found to be 141%, and the average tenacity at the break point is 2.23 gm/denier.

The following examples illustrate particular embodiments, but the invention is not limited to these particular embodiments.

EXAMPLE 1

A blend of 80% by wt. of PP granules (M.I., 230° C./2.16 kg, about 25 gm/10 min. and density of 0.910 gm/cc) with 20% by wt. of LLDPE (1-octene of about 10–15%; M.I. of 50 gm/10 min.; density of 0.926 gm/cc) is mechanically mixed and fed into an extruder maintained at about 245°–250° C. where the polymers are melted. The molten polymers are passed through a 3-dimensional dynamic mixer mounted at the outlet of the extruder. The dynamic mixer is designed, through a combination of shearing and mixing, to simultaneously divide the melt stream into superfine layers, and rearrange the layers tangentially, radially, and axially, thereby effecting good mixing of the immiscible PP and LLDPE.

The so-mixed melt is transported from the dynamic mixer, by a gear pump, through a spinnerent having 20,500 openings. The formed filaments are cooled by a side-stream of air, wound on a take-up roller, stretched over a preheated heptet of Godet rollers (90°–140° C.), run through an air-heated annealing oven (150°–170° C.), followed by another heptet of Godet rollers (100°–140° C.), before crimping and cutting of the continuous fibers into 38 mm staple fibers. Appropriate spinn-finishes are applied to aid the operation. The stretch ratio is 3.1X.

The resulting fibers have about 20 cpi (crimps per inch) and the titre is in the range of 2.0–2.5 dpf (denier per filament). The mechanical properties of the fibers, measured 3 weeks after production, are as follows (average of 15 randomly sampled fibers): Titre of 2.14 dpf: tenacity (tensile at break) of 4.73 gm/denier; elongation (at break) of 52%. The "hand" (softness) was judged better than that of similar PP fibers alone.

EXAMPLE 2

This example is like Example 1 above except that 30 wt. % of the LLDPE and 70 wt. % of the PP is used.

Results: Titre of 2.66 dpf; tenacity of 3.23 gm/denier: elongation of 61%. The hand was clearly better than PP alone.

EXAMPLE 3

This example is like Example 1 above except that the LLDPE contains 1-butene instead of 1-octene. It also has M.I. of 50 gm/10 min., a density of 0.926 gm/cc, and comprises 20% by wt. of the blend.

Results: Titre of 2.24 dpf; tenacity of 3.93 gm/denier; elongation of 48%. The hand was judged better than PP alone.

The following Table I illustrates the change in properties when measured about 120 days following the initial measurements shown in Examples 1–3 above.

TABLE I

| Run | Ratio PP/PE | DENIER First Measure | DENIER Second Measure | TENACITY First Measure | TENACITY Second Measure | ELONGATION First Measure | ELONGATION Second Measure |
|---|---|---|---|---|---|---|---|
| 1 | 80/20 | 2.14 | 2.81 | 4.73 | 3.41 | 52 | 70 |
| 2 | 70/30 | 2.66 | 2.69 | 3.23 | 3.37 | 61 | 72 |
| 3 | 80/20 | 2.24 | 3.00 | 3.93 | 2.99 | 48 | 63 |

The 70/30 blend in the table above exhibited very little change in denier and tenacity; this is an indication that there has been very little change in the dimensions of the fibers caused by stress relaxation during storage. The 70/30 blend is found to exhibit a high strength non-woven structure (about 2650 gm. force to break a 1' wide strip) when thermally bonded at about 148° C. under 700 psi pressure to form a 1 oz./yd$^2$ sheet.

EXAMPLE 4

Each of the following LLDPE's is blended as in Example 1 with the PP at ratios of PP/PE as indicated below, and the blends are all successfully spun as fibers at two stretch ratios of about 2.0 and about 2.7.

| LLDPE | Ratio of PP/PE |
|---|---|
| 50 MFR, 0.926 density (1-octene) | 25/75, 45/55, 65/35, 85/15 |
| 105 MFR, 0.930 density (1-octene) | 25/75, 45/55, 65/35 |
| 26 MFR, 0.940 density (1-octene) | 25/75, 45/55, 65/35, 85/15 |
| 50 MFR, 0.926 density (1-butene) | 25/75, 45/55, 65/35 |

EXAMPLE 5

In this set of data, the following described blends are used, wherein the PP used in each is a highly crystalline PP having a M.F.R. of 25 gm/10 minutes as measured by ASTM D-1238 (230° C., 2.16 Kg) and the M.F.R. of the PE's are measured by ASTM D-1238 (190° C., 2.16 Kg). All of the PE's are LLDPE's identified as:

PE-A - LLDPE (1-octene comonomer), 50 M.F.R., 0.926 density

PE-B TM LLDPE (1-octene comonomer), 105 M.F.R., 0.930 density

PE-C - LLDPE (1-octene comonomer), 26 M.F.R., 0.940 density

PE-D - LLDPE (1-butene comonomer), 50 M.F.R., 0.926 density

Blends made of the above described polymers are made into fibers in the manner described hereinbefore, the results of which are shown below in Table II.

TABLE II

| | Run No. | PE Used | Wt. Ratio PE/PP | Stretch Ratio | Titer (denier) | Tenacity g/denier | % Elong. |
|---|---|---|---|---|---|---|---|
| | 1 | A | 25/75 | 2.0 | 4.15 | 1.87 | 191 |
| 1 | 2 | A | 25/75 | 2.7 | 2.88 | 2.61 | 99 |
| | 3 | A | 45/55 | 2.0 | 4.15 | 1.67 | 217 |
| | 4 | A | 45/55 | 2.85 | 3.27 | 2.17 | 140 |
| 1 | 5 | A | 65/35 | 2.0 | 4.79 | 1.13 | 298 |
| | 6 | A | 65/35 | 2.7 | 3.53 | 1.56 | 208 |
| | 7 | A | 85/15 | 2.0 | 4.27 | 1.00 | 307 |
| 2 | 8 | A | 85/15 | 2.7 | 3.52 | 1.21 | 216 |
| | 9 | A | 85/15 | 3.0 | 3.06 | 1.63 | 150 |
| | 10 | B | 25/75 | 2.0 | 4.48 | 1.88 | 243 |
| 2 | 11 | B | 25/75 | 3.1 | 2.88 | 2.85 | 76 |
| | 12 | B | 45/55 | 2.0 | 4.23 | 1.47 | 225 |
| | 13 | B | 45/55 | 3.1 | 2.85 | 2.18 | 100 |

TABLE II-continued

| | Run No. | PE Used | Wt. Ratio PE/PP | Stretch Ratio | Titer (denier) | Tenacity g/denier | % Elong. |
|---|---|---|---|---|---|---|---|
| 3 | 14 | B | 65/35 | 2.0 | 4.17 | 1.07 | 261 |
| | 15 | B | 65/35 | 3.1 | 2.65 | 1.74 | 113 |
| | 16 | D | 25/75 | 2.0 | 3.87 | 1.96 | 199 |
| 3 | 17 | D | 25/75 | 2.7 | 2.91 | 2.87 | 84 |
| | 18 | D | 25/75 | 3.1 | 2.51 | 3.61 | 41 |
| | 19 | D | 45/55 | 2.0 | 4.15 | 1.62 | 241 |
| 4 | 20 | D | 45/55 | 2.7 | 3.07 | 2.06 | 126 |
| | 21 | D | 65/35 | 2.0 | 4.39 | 1.01 | 291 |
| 1 | 22 | D | 65/35 | 2.7 | 3.08 | 1.50 | 145 |
| | 23 | C | 25/75 | 2.0 | 3.95 | 2.11 | 219 |
| | 24 | C | 25/75 | 3.1 | 2.66 | 3.17 | 80 |
| 1 | 25 | C | 25/75 | 3.5 | 2.36 | 3.06 | 91 |
| | 26 | C | 25/75 | 2.3 | 2.64 | 2.73 | 81 |
| | 27 | C | 25/75 | 2.3 | 2.11 | 2.46 | 144 |
| 2 | 28 | C | 45/55 | 2.0 | 4.01 | 1.90 | 266 |
| | 29 | C | 45/55 | 3.1 | 2.72 | 3.43 | 76 |
| | 30 | C | 45/55 | 3.5 | 2.05 | 3.64 | 50 |
| 2 | 31 | C | 45/55 | 2.7 | 2.88 | 3.08 | 80 |
| | 32 | C | 65/35 | 2.0 | 4.12 | 1.54 | 321 |
| | 33 | C | 65/35 | 2.7 | 3.05 | 2.19 | 169 |
| 3 | 34 | C | 85/15 | 2.0 | 3.94 | 1.28 | 351 |
| | 35 | C | 85/15 | 2.7 | 2.84 | 1.83 | 194 |
| | 36 | C | 85/15 | 3.1 | 2.79 | 2.01 | 187 |

Figure 1:
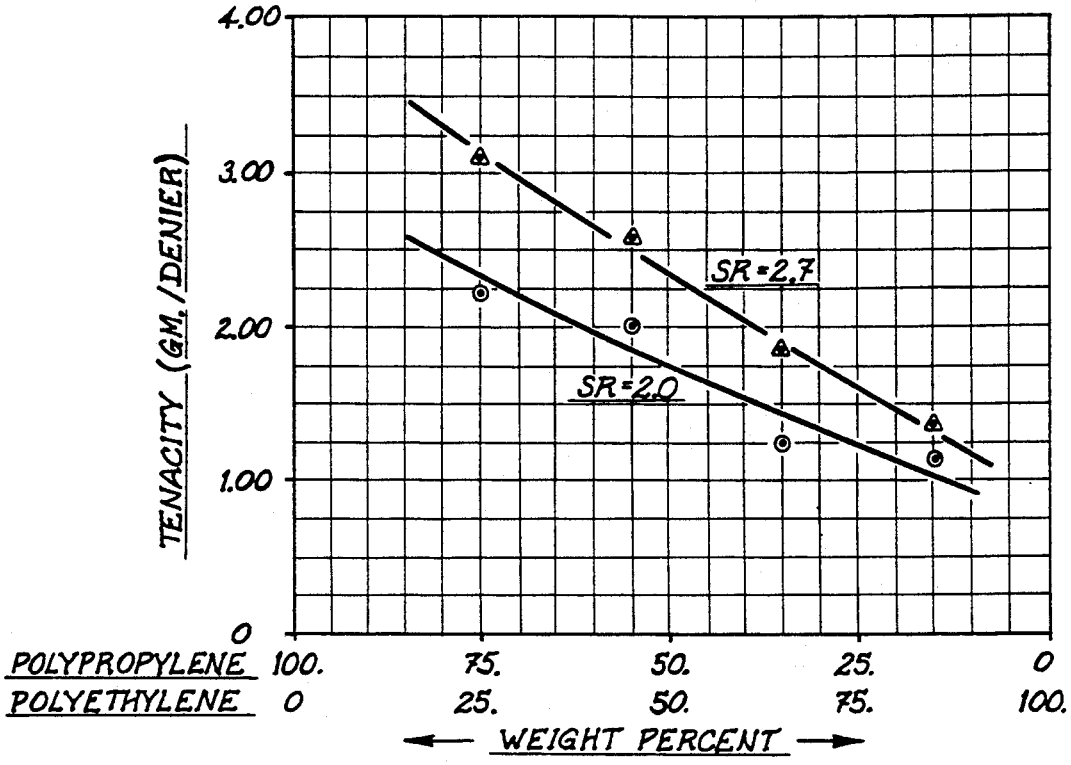
FIG. 1 illustrates some of the data for PE-A.
Figure 2:
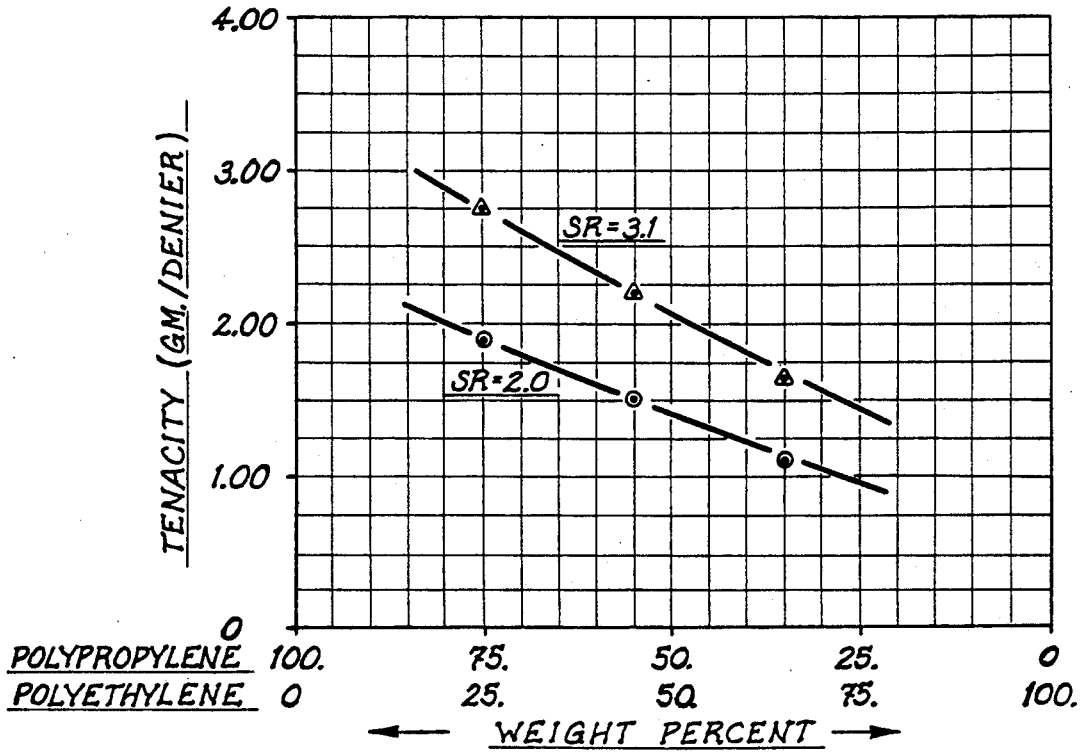
FIG. 2 illustrates some of the data for PE-B.
Figure 3:
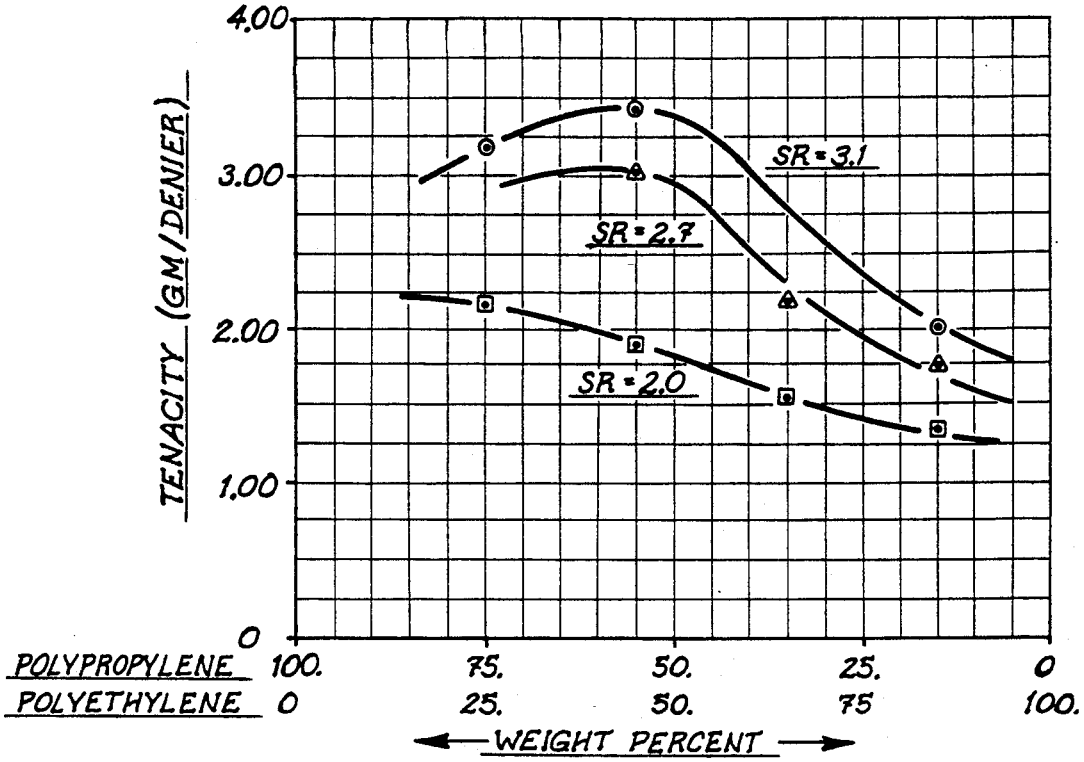
FIG. 3 illustrates some of the data for PE-C.
Figure 4:
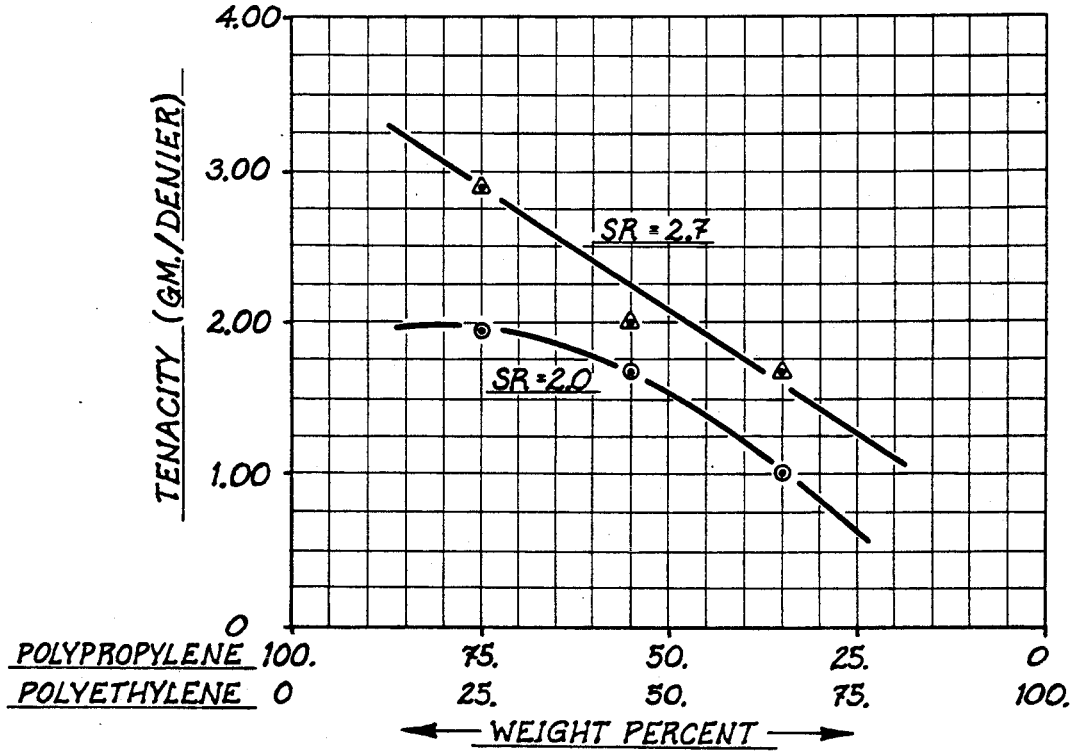
FIG. 4 illustrates some of the data for PE-C.

Thermal bondability of biconstituent fibers are demonstrated using a PE/PP blend of 30/70 wherein PE-A is employed. After being stored for 150 days after spinning, thermal bonding is tested by preparing 10 samples of 1 inch wide slivers using a rotaring device, such as is commonly used in the industry, aiming at 1 oz. per yd.$^2$ web weight. Results of the 10 measurements, normalized to 1 oz. per yd$^2$. The pressure between the calanders during the thermal bonding is maintained constant at 700 psig in preparing fabrics. Listed below are the bonding temperature and corresponding tensile force, in grams, required to break the fabric.

| Bonding Temp. °C. | Force to Break, Grams |
|---|---|
| 141 | 1260 |
| 144 | 1250 |
| 147 | 2600 |
| 149 | 2750 |

For comparison with the above, the typical break force usually obtained for PP based fabrics is 2500±150 grams and the typical range usually obtained for LLDPE is 1300–1500 grams.

It is noticed that the "drape" and softness of fabrics made using the PE/PP biconstituent fibers in spunbonding is superior to that of PP fibers alone.

Further Comments About the Fiber-Making

In similar manner, fibers are prepared using a melt temperature in the range of 180°-260° C., preferably 200°-250° C. Spinning rates of 20 to 120 m/min. are preferred. Stretch ratios in the range of 1.5-5X, preferably 2.0-3.0X are preferred. At excessive Godet rolls temperatures, sticking of the fibers to the rolls may take place unless a spinn-finish is used.

Practitioners of the art routinely measure the "hand" (softness) by merely feeling and squeezing a wad or mat of the fibers being compared.

The diameter of the PE fibrils which are contained in the blends are all of sub-micron size and most of them have a diameter of less than about 0.05 microns.

Whereas the blends may be of any denier size, the preferred denier size is less than about 30 and the most preferred denier size is in the fine denier range of about 0.5 to about 15, especially in the range of about 1 to about 5.

The blends of this invention are useful in a variety of applications, such as non-wovens, wovens, yarns, ropes, continuous fibers, and fabrics such as carpets, upholstery, wearing apparel, tents, and industrial applications such as filters and membranes.

The blends over the range of PP/PE ratios of 20/80 to 90/10 exhibit surprisingly good strength during extrusion and are not subject to the breaking one normally obtains from blends of incompatible polymers.

We claim:

1. In a process wherein a molten blend of highly crystalline polypropylene (PP) and linear low density polyethylene (LLDPE) is used in producing biconstituent fibers by passing the molten blend through an intensive mixer just before it passes through the fiber dies and is drawn into fibers of a size less than a denier of 30, the improvement which comprises using as the LLDPE component one having a melt flow rate in the range of about 12 to about 120 g/10 minutes, wherein the ratio of PP/LLDPE in the molten blend is within the range of 3.55 to 0.82, whereby either (a) fibers produced from blends having the PP/LLDPE ratio within the range of 3.55 to 1.22 are substantially characterized by having a substantial amount of the LLDPE in the form of fine fibrils randomly arrayed in a PP continuous phase, or (b) whereby fibers produced from blends having the PE/LLDPE ratio within the range of 1.22 to 0.82 are substantially characterized by being substantially co-continuous lamellar structures.

2. The process of claim 1 wherein the LLDPE has a melt flow rate of about 50±20 g/10 minutes.

3. The process of claim 1 wherein the LLDPE has a density in the range of about 0.92 to about 0.94 g/cc.

4. The process of claim 1 wherein the fiber has a size in the range of about 0.5 to 15 denier.

5. The process of claim 1 wherein the ratio of PP/LLDPE is within the range of 3.55 to 1.22.

6. The process of claim 1 wherein the ratio of PP/LLDPE is within the range of 1.22 to 0.82.

7. The process of claim 1 wherein the LLDPE is comprised of ethylene copolymerized with an amount of octene sufficient to cause the density to be in the range of about 0.88 to about 0.95 g/cc.

* * * * *